US006595280B2

(12) United States Patent
Traylor

(10) Patent No.: US 6,595,280 B2
(45) Date of Patent: Jul. 22, 2003

(54) SUBMERSIBLE WELL PUMPING SYSTEM WITH AN IMPROVED HYDRAULICALLY ACTUATED SWITCHING MECHANISM

(76) Inventor: Leland Bruce Traylor, 11510 Ranchitos Ave., NE., Albuquerque, NM (US) 87109

( * ) Notice: Subject to any disclaimer, the term of this patent is extended or adjusted under 35 U.S.C. 154(b) by 51 days.

(21) Appl. No.: 09/947,084

(22) Filed: Sep. 3, 2001

(65) Prior Publication Data

US 2003/0042017 A1 Mar. 6, 2003

(51) Int. Cl.[7] ..... E21B 43/00

(52) U.S. Cl. ..... 166/105.5; 166/65.1; 417/368; 417/414; 417/473

(58) Field of Search ..... 166/105.5, 65.1, 166/105; 417/368, 414, 473, 472, 366, 390

(56) References Cited

U.S. PATENT DOCUMENTS 2,435,179 A 1/1948 McGovney
2,861,518 A 11/1958 Pleuger
2,961,966 A 11/1960 Zillman
6,017,198 A 1/2000 Traylor
6,059,539 A * 5/2000 Nyilas et al.
6,183,217 B1 2/2001 Elliott

* cited by examiner

*Primary Examiner*—Roger Schoeppel
(74) *Attorney, Agent, or Firm*—Bauman, Dow, McIntosh & Leon, PC; Alberto A. Leon, Esq

(57) ABSTRACT

The invention generally concerns a submersible well pumping system comprising an axially elongated housing having a diameter less than the bore hole of the well, a multi-chamber hydraulically driven diaphragm pump, suspended in the well. The pump is driven by a self-contained, closed hydraulic system, activated by an electric or hydraulic motor. The flow of working fluid into and out of the working fluid sub-chambers is controlled by a two state main valve with a means to insure the main valve is completely switched, in turn controlled by a control valve which senses the differential pressure across the working diaphragm and generates a hydraulic signal to change the state of the two state main valve, typically when either diaphragm reaches the top of the pumping stroke. Singly or in combination, the means to assure the main valve is completely switched between the two states is an energy storage device, hysterisis in the control valves and or a two position latch the main valve.

27 Claims, 2 Drawing Sheets

SUBMERSIBLE WELL PUMPING SYSTEM WITH AN IMPROVED HYDRAULICALLY ACTUATED SWITCHING MECHANISM

BACKGROUND

1. Technical Field

This invention relates generally to submersible well pumping systems. This invention relates particularly to a positive displacement pumping system enclosed in a housing and comprising a multi-chamber hydraulically driven diaphragm pump, with an improved hydraulically actuated switching mechanism.

2. Description of the Background Art

Hydraulically driven diaphragm pumps are positive displacement pumps which are nearly immune to the effects of sand in the pumped fluid because the pressure generating elements are isolated from the pumped fluid by a flexible diaphragm. In well pump applications, this type of pump is driven by a self contained, closed hydraulic system, activated by an electric or hydraulic motor where the pump, closed hydraulic system, and the motor are enclosed in a common housing and submerged in a well. There are many examples of this type of well pump in the patent literature, but currently none are in use as well pumps because of high cost and/or poor reliability. In well pump applications, the key design feature is the switching mechanism used to redirect or reverse the flow of working fluid from the fluid source, referred to as the auxiliary pump, to the working fluid sub-chambers. The reversal of the flow causes the pumped fluid to move into and out of-pumped fluid sub-chambers through check valves, accomplishing the pumping action.

U.S. Pat. No. 2,435,179 discloses a hydraulically driven diaphragm pump which uses a hydraulically actuated valve to reverse the flow of working fluid. The valve is driven by differential pressure between the fluid inside the working diaphragm (working fluid) and the fluid outside the working diaphragm (pumped fluid). Normally, no differential pressure exists between the two volumes. The pump creates the differential pressure required to reverse the pump by completely filling the diaphragm, causing it to stretch after it is completely full. The amount of pressure generated is limited by the strength of diaphragm material and has the disadvantage of creating diaphragm stress, which can lead to premature diaphragm failure. To maximize diaphragm life, this differential pressure must be limited to the lowest level possible.

The '179 patent uses two sets of diaphragms, one set to control the valve, and the other set to achieve pumping. The pumping diaphragms are located inside the pumping chambers, and the control diaphragms are located between the working fluid inside the pumping chambers and the pump outlet. The external surfaces of the working and control diaphragms are separated by an outlet check valve, creating the possibility that the external pressure would be higher on the control diaphragm due the presence of the checkvalve. If the inlet pressure is higher than the outlet pressure (a common occurrence in well pumps) the pump will not operate and could be damaged. This situation commonly occurs when the pump is installed in a standing fluid column, before fluid has a chance to equalize by flowing through the pump checkvalves. This arrangement also limits the usefulness of the pump by limiting it to use in conjunction with a large diameter liner rather then a more conventional, smaller diameter drop pipe.

A more significant problem occurs in low volume applications. The nature of the pump requires that the hydraulically actuated valve be driven by the same pressure source controlled by the valve, which causes the valve driving force to be released when the valve transverses an intermediate position between states. In low volume applications, this single valve can stop in an intermediate position before it has completely reversed the pump. This can cause the pump to either dither (rapid but incomplete movement of the working fluid in one direction), or go into a mode where half the flow is directed into each chamber or stops, which causes the pump to stop functioning.

Other problems will occur with the valve setup disclosed in the '179 patent. For example, the control diaphragm is acting directly on a tappet, leading to fluid accumulation between the diaphragm and the tappet, which in turn leads to diaphragm failure unless measures are taken to relieve the fluid. For these and other reasons, the pump described in the '179 patent has never been used in a practical application. This patent application addresses those shortcomings and describes a practical well pump with in improved control valve.

U.S. Pat. No. 2,961,966 discloses another method to reverse the flow of working fluid by reversing the direction of rotation of the electric motor driving the auxiliary pump. That patent discloses a method to sense the differential pressure between the working fluid and the pumped fluid to activate the electrical braking and reversal of the electric motor driving the auxiliary pump. That method also leads to diaphragm stress because differential pressure is required across the diaphragm to actuate the sensor. In addition motor reversal requires very complex electronics. Although theoretically possible, in practice the complexity of that method leads to high expense and unreliable operation due to the difficulty of controlling and reversing the electric motor in a downhole environment.

U.S. Pat. No. 6,017,198 discloses another method to reverse the flow of working fluid, namely the use of sensors and electronics to detect the fact that the diaphragm is full, and reverse the direction of flow by using an electrically actuated valve. This method works very well, but requires relatively complex electronics and a connection into the main power cable. Sealing electronics and power cables against high ambient pressure environments found in wells is expensive and can lead to premature failures of the pump due to high ambient pressure related electrical shorts.

Another unexpected problem can occur when pumping in certain environments, namely the accumulation of gas or the corrosion of the internal workings of the pump due to saturation of a corrosive gas through the diaphragm into the pump workings. Loss of working fluid and a related problem of working fluid contamination of the pumped fluid can also be problems, especially in water well applications where oil in the drinking water is not acceptable. This patent application describes two methods to address these problems increasing the applicability of the pump into more restrictive settings.

A pumping system, like the one disclosed herein, which combines the high reliability and ease of installation of a submersible centrifugal pump with the high efficiency in low flow-high pressure applications of a positive displacement pump constitutes a significant advancement in the state of the relevant art.

SUMMARY

The primary pumping system of the invention comprises an axially elongated housing having a diameter less than the bore hole of the well, a pump with a plurality of pumping chambers of fixed volume, each pumping chamber is further subdivided by a flexible diaphragm into two sub-chambers, a working fluid sub-chamber and a pumped fluid sub-chamber, typically made of rubber. Each pumped fluid sub-chamber is connected to the bore hole of the well through a check valve which allows well fluid to flow into the pumped fluid sub-chamber but prevents flow in the reverse direction. Likewise, each pumped fluid sub-chamber is connected through a check valve which allows the well fluid to flow out of the pumped fluid sub-chamber to the pump outlet but prevents flow in the reverse direction. Such an arrangement allows well fluid to flow through the pumped fluid subchambers, thereby moving the pumped fluid from the bore hole of the well to the pump outlet and eventually to the surface. The movement of well fluid into and out of the pumped fluid sub-chambers is caused by the insertion or withdrawal of working fluid into and out of the working fluid sub-chambers. The movement of working fluid is caused by a closed hydraulic system which forces working fluid into one or more working fluid sub-chambers while simultaneously withdrawing working fluid from one or more opposite working fluid sub-chambers. The closed hydraulic system comprises an auxiliary pump, a main valve, a plurality of control valves, a plurality of control chambers, the working fluid subchambers, and passageways. The passageways extend from the auxiliary pump to the main valve, from the main valve to the control valves, and from the main valve to the working fluid sub-chambers. The control chambers are connected to the control valves. The auxiliary pump, which can be a piston pump, gear pump, centrifugal pump or any type of pump that produces the required flow rates and pressures, provides inlet and outlet flows of working fluid. The main valve is connected to the inlet and to the outlet of the auxiliary pump and to two sets of working fluid sub-chambers, each set comprising roughly equal displacement.

The main valve has two states. In the first state, the inlet of the auxiliary pump is connected to one set of working fluid sub-chambers, and the outlet of the auxiliary pump is connected to the other set of working fluid sub-chambers. In the second state, the main valve connects the set of working fluid sub-chambers previously connected to the input of the auxiliary pump, to the outlet of the auxiliary pump, and connects the input of the auxiliary pump to the set of working fluid sub-chambers previously connected to the output of the auxiliary pump.

The main valve is driven between states by pilot pressure applied to two control ports. The valve is bi-directional, that is it will move between two states under the influence of pilot pressure in either direction, the direction of change determined by which port is under the higher pressure. Both control ports are normally connected to the low pressure (input) of the auxiliary pump through the control valves. One control valve is connected to each of the two control ports. Each control valve is also connected to the appropriate working fluid sub-chamber and control chamber. The control chambers are volumes of working fluid, located in the vicinity of the matching pumped fluid and working fluid sub-chambers, having rigid boundaries except where it is separated from the pumped fluid sub-chamber by a flexible diaphragm. When the pressure in the working fluid sub-chamber exceeds the pressure in a matching control chamber by a predetermined amount (due the filling of the working fluid sub-chamber), the control valve opens and allows flow from the working fluid sub-chamber to the control port on the main valve. This creates differential pressure between the control ports and drives the main valve to the opposite state.

The main valve must be able to complete the movement between the two states while the switching of the main valve is eliminating the differential pressure activating the control valve. If the main valve stops before the center position is passed, the valve will return to the original state and create a dithering, or rapid cycling condition, eventually leading to pump failure. Another failure mode occurs when the main valve stops short of full switching.

To prevent this, an energy storage element combined with hysteresis and/or a latch is added to the system to create a bistable main valve. The energy storage element stores energy in a spring, compressed gas, kinetic energy of a moving mass, or by lifting a mass. In a pump, the most convenient method to store energy is in a spring. In this system the pumping diaphragm provides a convenient spring to store the energy needed to shift the main valve, when differential pressure expands the pumping diaphragm at the point at which the main valve is ready to shift. The pumping diaphragm acts like an accumulator, prolonging the pressure in the system even after the main valve has cut off and reversed the flow of fluid into the working fluid sub-chamber. This stored energy maintains the differential pressure across the pumping diaphragm and maintains the control valve in the activated condition while the main valve completes the transition between the two states.

This effect can be enhanced by providing a detent latch on the main valve that will prevent the transition of the main valve until sufficient pressure and flow are present at the control ports. This latch provides two beneficial effects. First, it eliminates the tendency of the main valve to move in response to transient signals such as water hammer, common to this type of pump. This prevents the valve from getting hung up under certain conditions of operation. Second, it increases the speed and force of the transition of the main valve by allowing the control valve to fully open before any movement of the main valve. This sharpens the transition increasing the possibility that the valve will fully shift under all conditions.

Hysteresis in the two control valves also helps to assure the main valve completes the transition between states. Hysteresis in this context is the tendency of the control valve to actuate at one pressure, and unactuate at a lower pressure. Hysteresis is a normally undesirable characteristic found in most valves, and is caused by fluid damping or internal friction in the valve. The amount of Hysteresis can be controlled and increased by adding more damping or friction. Hysteresis acts similarly to the energy storage effect, increasing the amount of time the control valve is open after the main valve starts transitioning, allowing the main valve to complete the transition before the control valve closes.

Other design features are important to assure proper operation. More reliable operation is achieved if the volume of the main valve control ports is maintained as small as possible. To achieve this the stroke of the main valve should also be maintained as small as possible. Attention should also be paid to passageway lengths and diameters to minimize pressure drops in the system.

A small amount of fluid is moved from the working fluid sub-chamber to the control chamber when the valve is switched. To cycle the fluid from the control chamber to the working fluid sub-chamber, a check valve allowing flow from the control chamber to the working fluid sub-chamber or a small orifice between the chambers can be used.

The auxiliary pump is driven by a prime mover that can be an AC or DC rotary electric motor, a AC or DC linear motor, a hydraulic motor or mechanical actuation from the surface. In the preferred embodiment of the invention, the prime mover is contained in the same housing as the pump, and is powered electrically. The pump may be connected to the motor in such a way that they share a common fluid supply, that is the same fluid is used in the electric motor as is used as the working fluid in the pump. In this arrangement, the fluid input of the auxiliary pump is connected to the electric motor fluid volume. This arrangement has the advantage of reducing the possibility of failure due to working fluid leakage around shaft seals, because the shaft seal between the pump and the motor is eliminated, which results in no moving seals between the working fluid and the well fluid. The fluid in the electric motor volume and working fluid in the closed hydraulic system in the pump expand and contract with temperature and pressure and must be equalized with the pump inlet to prevent pump and/or electric motor failure. Because the electric motor volume and the closed hydraulic system in the pump constitute one fluid volume, the working fluid sub-chambers compensate for this expansion and contraction for both the electric motor volume and the closed hydraulic system in the pump, eliminating the need for a separate expansion compensation for each volume.

Another favorable arrangement is achieved by separating the electric motor fluid and the pump working fluid volumes through a shaft seal between the auxiliary pump and the electric motor. In this arrangement, different fluids with different properties can be used in each volume. To reduce the likelihood of failures, the shaft seal is situated between the motor fluid and pump working fluid volumes, and both are equalized using separate expansion compensation to the pump inlet so that no differential pressure exists across the seal. This is accomplished by equalizing the electric motor to the pump inlet through an expansion diaphragm in the motor and by separately equalizing the closed hydraulic system in the pump, which is also equalized to the pump inlet by the working fluid sub-chambers.

To further compensate for the potential loss of fluid from the rotating seal, a make up valve may be used between the pump inlet and the well bore to introduce make up fluid through a filtered inlet. The valve would be spring loaded to open when the differential pressure between the pump inlet and the well bore indicates the hydraulic system requires more fluid to operate properly. The working fluid must be compatible with the well fluid, such as in the case where hydraulic oil is used as the working fluid in an oil well, or a water based fluid is used in a water well.

Another common problem in some applications is the diffusion of gas across the pumping membrane from the well fluid. This occurs when hydrogen, carbon dioxide or hydrogen sulfide are present in significant quantities. To eliminate these gasses from the system, a gas trap may be used. The gas trap consists of a small orifice connecting a rigid chamber located at the highest point in the working fluid sub-chamber to the working fluid sub-chamber. A spring loaded check valve is located at the highest point in the rigid chamber, and is set to open at a pressure slightly higher than the system switch pressure. When the system cycles between high and low pressure, gas will accumulate in the rigid chamber by passing through the small orifice under the influence of gravity. Once in the rigid chamber, the gas will exert pressure on the relief valve when the system switches from high to low pressure. When sufficient gas has accumulated, the relief valve will open and allow the gas to escape to the pumped fluid and out of the closed hydraulic system. Two gas traps may be required, one in each working fluid sub-chamber. A semi-permeable membrane can also be used in place of the check valve.

BRIEF DESCRIPTION OF THE DRAWINGS

These and other features, aspects and advantages of the present invention will become better understood with regard to the following description, appended claims and accompanying drawings, where:

DESCRIPTION OF THE PREFERRED EMBODIMENT

Figure 1:
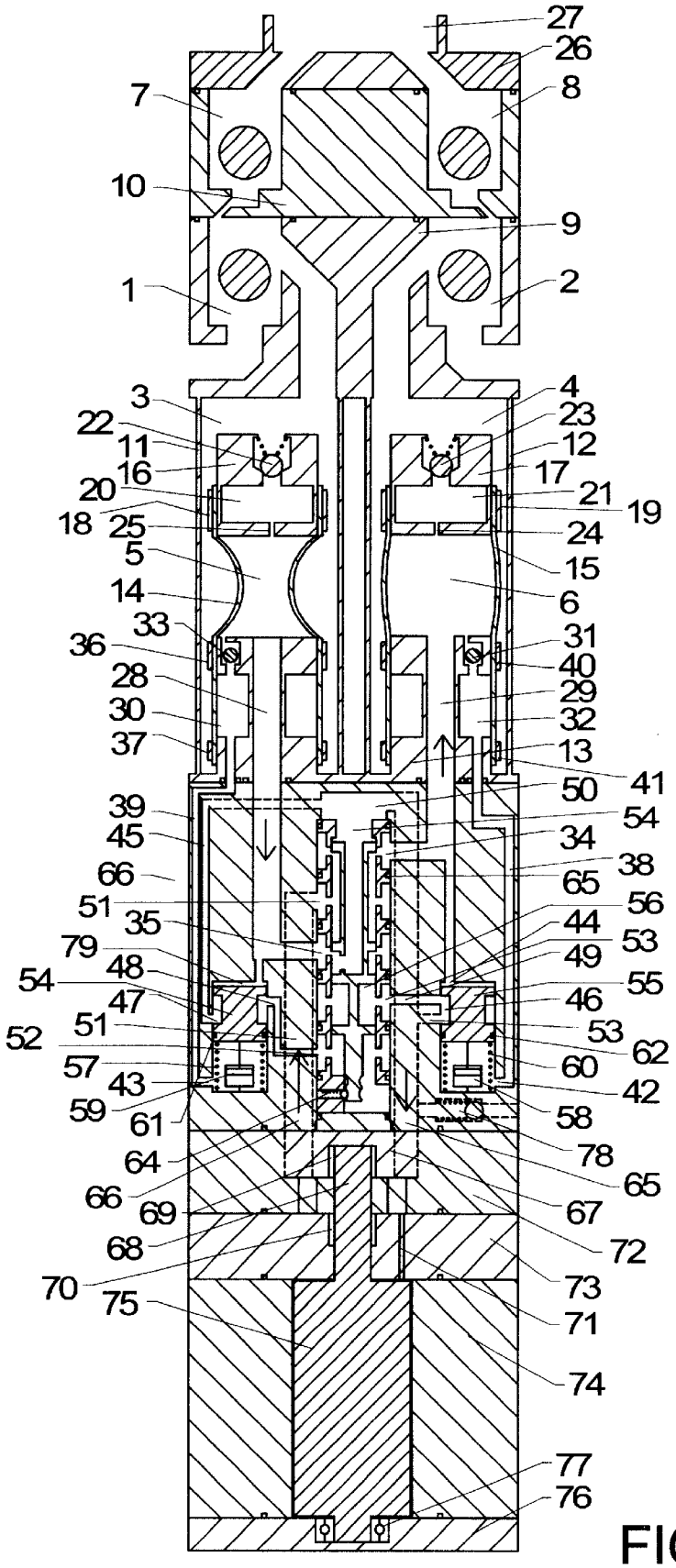
FIG. 1 is a cross sectional schematic view of the pumping system as it would be in installed in a typical well. One of the control valves is shown in an actuated position, at the time just before the main valve shifts.

Referring now to the drawings, and particularly to FIG. 1, Well fluid to be pumped enters the pumping system through inlet checkvalves 1 and 2. The inlet checkvalves 1 and 2 allow pumped fluid to flow from the bore hole of the well into the pumped fluid sub-chambers, 3 and 4. The outlet checkvalves 7 and 8 allow pumped fluid to flow out of the pumping system from pumped fluid sub-chambers, 3 and 4 to housing 26 into pump outlet 27. The pumped fluid subchambers 3 and 4 and working fluid subchambers 5 and 6 are a fixed volume defined by the inlet checkvalves 1 and 2, the outlet checkvalves 7 and 8, checkvalve housings 9 and 10, pumping tubes 11 and 12, and base housing 13. The pump is divided into two sets of pump chambers, the first is pumped fluid subchamber 3 and working fluid subchamber 5; the second is pumped fluid subchamber 4 and working fluid subchamber 6. The pumped fluid subchamber 3 is separated from the working fluid subchamber 5 by a flexible diaphragm 14, similarly pumped fluid subchamber 4 is separated from working fluid subchamber 6 by flexible diaphragm 15. The working fluid volume, defined by working fluid subchambers 5 and 6 plus all valves, motors and passageways connected to these working fluid subchambers are statically sealed from the pumped fluid and the outside of the pump, and form a constant volume of working fluid. Typically the working fluid is hydraulic oil, but any fluid meeting the functional requirements of the system will work. Both flexible diaphragms 14 and 15 are tubular in shape and are made of fiber reinforced rubber or other suitable material, with the upper ends of the flexible diaphragms 14 and 15 plugged by identical diaphragm caps 16 and 17. The flexible diaphragms 14 and 15 are secured to their respective diaphragm caps by clamps 18 and 19. Shown inside diaphragm caps 16 and 17 are gas traps 20 and 21 and spring loaded checkvalves 22 and 23. Gas traps 20 and 21 are separated from working fluid subchambers 5 and 6 by orifices 24 and 25 respectively. As the pump operates, air from the working fluid moves from working fluid subchambers 5 and 6, through orifices 24 and 25 to collect in gas traps 20 and 21 under the influence of gravity. When sufficient air has accumulated in gas traps 20 or 21, a spring loaded checkvalve, either spring loaded checkvalve 22 or spring loaded checkvalve 23 will open when the pump changes between the high pressure upstroke to the lower pressure downstroke. The air, because it is under pressure, and cannot escape through the orifices 24 and 25, will escape into the pumped fluid subchambers 3 and 4. A gas but not liquid permeable membrane such as that supplied by Gore Industries can replace Checkvalves 22 and 23.

Figure 2:
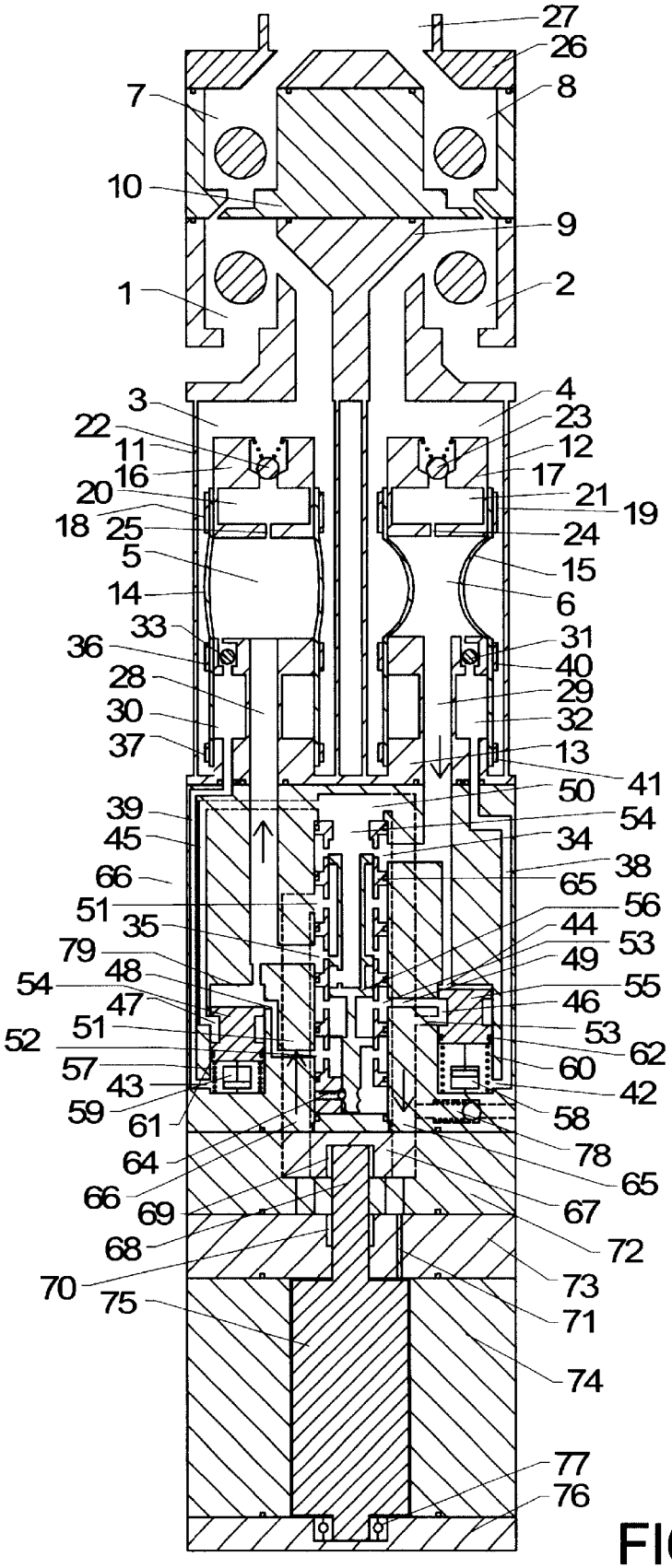
FIG. 2 is the same as FIG. 1, except the main valve is shown in the opposite position from FIG. 1, and both control valves are shown in the rest positions.

Working fluid flows from the working fluid subchamber 6 through passageway 29 to main valve port 34. Conversely, fluid flows to the working fluid subchamber 5 through passageway 28 from main valve port 35. Checkvalves 31 and 33 connect working fluid subchambers 6 and 5 to control chambers 30 and 32 respectively. The control chambers 30 and 32 are formed by the base housing 13, and the pumping diaphragms 14 and 15. Clamps 36, 37, 40 and 41 attach the pumping diaphragms 14 and 15 to the base housing 13, forming a seal between the two. Passageways 38 and 39 connect the control chambers 32 and 30 to control valve ports 42 and 43 respectively. Control valve ports 44 and 79 are connected through passageways 29 and 28 to working fluid subchambers 6 and 5 respectively. Control valve ports 47 and 46 are connected through passageways 45 and 53 to low pressure port 50. Control valve port 48 is connected to main valve control port 51 and likewise control valve port 49 is connected to main valve control port 53. When the pressure in control valve port 79 exceeds the pressure in control valve port 43 by a preset amount as regulated by spring 57, the spool 54 moves, and allows the flow of pressurized fluid from control valve port 79 to main valve control port 51. This pressure will force main valve spool to move from the position shown in FIG. 1 to the position shown in FIG. 2, reversing the flow of fluid to the working fluid subchambers 5 and 6. As this transition is taking place, the differential pressure between control valve port 43 and control valve port 79 is eliminated, and the valve closes due to spring force generated by spring 57. Dashpot 59 and friction ring 61 are used to regulate the rate at which the spool 54 closes after the pressure is eliminated. When the pressure in control valve port 79 does not exceed the pressure in control valve port 43 by a preset amount, the spool 54 is in a rest position as shown in FIG. 2, and allows the flow of fluid from control valve port 47 to main valve control port 51. Spool 54 is shown in the activated position in FIG. 1. When the pressure in control valve port 44 exceeds the pressure in control valve port 42 by a preset amount, the spool 55 moves, and allows the flow of pressurized fluid from control valve port 44 to main valve control port 49. This pressure will force main valve spool to move from the position shown in FIG. 2 to the position shown in FIG. 1, reversing the flow of fluid to the working fluid subchambers 5 and 6. As this transition is taking place, the differential pressure between control valve port 44 and control valve port 42 is eliminated, and the valve closes due to spring force generated by spring 60. Dashpot 58 and friction ring 62 are used to regulate the rate at which the spool 55 closes after the pressure is eliminated. When the pressure in control valve port 44 does not exceed the pressure in control valve port 42 by a preset amount, the spool 55 is in a rest position, and allows the flow of fluid from control valve port 46 to main valve control port 53. Spool 55 is shown in the rest position. Main valve spool 56 is held in one of two stable positions by detent latch 64. Support housing 65 is stationary in main housing 66, and contains the main valve spool 56. The support housing allows for a shorter transition of the main valve spool 56, between the two positions shown in FIGS. 1 and 2.

Hydraulic fluid flows from the auxiliary pump outlet 66, through passageway 52 to main valve port 51. Hydraulic fluid flows to auxiliary pump inlet 65, through passageway 50 from auxiliary valve port 54. The auxiliary pump outlet 66, and auxiliary pump inlet 65 are connected to auxiliary pump 67, which consists of two intermeshing gears located in a tightly fitting housing formed by pumping housing 72 and motor adaptor 73. Bearings 69 and 70 support the main shaft 68. The gears are driven by shaft 68, connected to rotor 75 that spins under the influence of stator 74. Passageway 71 connects the auxiliary pump inlet 65 to the fluid volume inside the electric motor, which comprises a rotor, 75, stator 74, motor base 76, bearing 77 and motor adaptor 73. Various seals of the classic O-ring configuration are used as shown to seal the housings. Optional make up valve 78 allows the flow of well fluid into the system as needed to make up for any fluid loss. A filter may be added to the system to improve reliability. For convenience prepackaged valves are available from several companies including Sun Hydraulics and Parker Hydraulics that incorporate the functions of the main valve and the control valves in a standard cartridge configuration.

What is claimed is:

1. A submersible well pumping system comprising:

a) an axially elongated housing having a diameter less than the bore hole of the well;

b) a plurality of rigid pumping chambers formed in the housing and enclosing pumping fluid and working fluid in a fixed volume;

c) flexible diaphragm means dividing each pumping chamber into two sub-chambers thus separating the pumped fluid from the working fluid;

d) pump inlet means connecting the pumped fluid sub-chambers and the bore hole of the well;

e) pump outlet means connecting the pumped fluid sub-chambers and the surface of the earth;

f) inlet check valve means per pumped fluid sub-chamber extending between the pump inlet and each pumped fluid sub-chamber allowing unidirectional flow of pumped fluid from the pump inlet means to the pumped fluid sub-chambers;

g) outlet check valve means extending from the pump outlet means to each pumped fluid sub-chamber allowing the unidirectional flow of pumped fluid from the pumped fluid sub-chambers to the pump outlet means;

h) a closed hydraulic system filled with working fluid;

i) an auxiliary pump circulating working fluid through the closed hydraulic system;

j) a two-state main valve engaged to the closed hydraulic system, extending between the auxiliary pump and the working fluid sub-chambers to alternately insert and simultaneously withdraw working fluid to the working fluid subchambers;

k) main valve actuation means providing mechanical motion to change the state of the main valve;

l) a plurality of control chambers comprising volumes of working fluid and located in the vicinity of matching pumped fluid and working fluid sub-chambers, having rigid boundaries except where separated from the pumped fluid sub-chamber by a flexible diaphragm;

m) a plurality of control valves, each connected to the main valve actuation means and to the appropriate working fluid sub-chamber and control chamber;

n) means to insure the main valve is completely switched;

o) a plurality of control chambers engaged to the control valves;

p) a plurality of fluid passageways extending from the auxiliary pump to the main valve, from the main valve to the control valves and from the main valve to the working fluid subchambers;

q) prime moving means attached to the auxiliary pump and driving the auxiliary pump;

r) a gas purging system comprising a plurality of gas traps, each gas trap further comprising a small orifice connecting a rigid chamber located at the highest point in the working fluid sub-chamber to the working fluid sub-chamber; and s) a relief valve located at the highest point in the rigid chamber, set to open at a pressure slightly higher than the system switch pressure.

2. A well pumping system according to claim 1 wherein the main valve actuation means comprises two (2) control ports driving the main valve between stages via pilot pressure.

3. A well pumping system according to claim 1 wherein the means to insure the main valve is completely switched comprises an energy storage system.

4. A well pumping system according to claim 3 wherein the energy storage system is a pumping diaphragm comprising a spring to store the energy needed to shift the main valve.

5. A well pumping system according to claim 3 wherein the energy storage system comprises compressed gas.

6. A well pumping system according to claim 3 wherein the energy storage system comprises kinetic energy of a moving mass.

7. A well pumping system according to claim 3 wherein the energy storage system comprises kinetic energy produced when lifting a mass.

8. A well pumping system according to claim 1 wherein the means to insure the main valve is completely switched comprises hysteresis.

9. A well pumping system according to claim 1 wherein wherein the means to insure the main valve is completely switched comprises hysteresis generated using damping.

10. A well pumping system according to claim 1 wherein the means to insure the main valve is completely switched comprises hysteresis generated using friction.

11. A well pumping system according to claim 1 wherein the means to insure the main valve is completely switched comprises a detent latch placed in the main valve.

12. A well pumping system according to claim 1 wherein the means to insure the main valve is completely switched comprises a combination of an energy storage system, hysteresis or a detent latch placed in the main valve.

13. A well pumping system according to claim 1 wherein the relief valve comprises a semi-permeable membrane.

14. A well pumping system according to claim 1 wherein the control chamber and the working fluid sub-chamber are co-located inside the pumping chamber.

15. A well pumping system according to claim 1 wherein the prime moving means is filled with working fluid.

16. A well pumping system according to claim 1 wherein the prime moving means is filled with prime mover fluid.

17. A well pumping system according to claim 1 wherein the prime moving means is located in the housing.

18. A well pumping system according to claim 1 wherein the prime moving means is an electric motor located inside the housing.

19. A well pumping system according to claim 1 wherein the prime moving means is a hydraulic motor driven from the surface of the earth.

20. A well pumping system according to claim 1 wherein the prime moving means is a mechanically actuated motor driven from the surface of the earth.

21. A well pumping system according to claim 1 wherein the auxiliary pump is a positive displacement pump.

22. A well pumping system according to claim 1 wherein the control valve is a rotary device.

23. A well pumping system according to claim 1 wherein the control valve is a linear device.

24. A well pumping system according to claim 1 wherein the prime mover fluid and the working fluid are connected by a fluid filled conduit, and the diaphragm means provides for the expansion of both the working fluid and the prime mover fluid.

25. A well pumping system according to claim 1 wherein the axially elongated housing is completely filled with working fluid and prime mover fluid, with the flexible diaphragm means in such an arrangements as to provide a seamless barrier with no moving seals.

26. A well pumping system according to claim 1 wherein the prime mover fluid is pressure-compensated to the pump inlet, and the working fluid in the axially elongated housing es pressure-compensated to the pump inlet such that pressures between the two fluids are equalized.

27. A well pumping system according to claim 1 wherein a make up valve is placed between the pump inlet and the well bore allowing introduction of make up fluid through a filtered inlet.

* * * * *